US005624180A

United States Patent [19]

Lanning

[11] Patent Number: 5,624,180

[45] Date of Patent: Apr. 29, 1997

[54] LIGHT STRING MOUNTING BRACKET

[76] Inventor: William C. Lanning, 2632 E. Adams Ave., Orange, Calif. 92667

[21] Appl. No.: 415,346

[22] Filed: Apr. 3, 1995

[51] Int. Cl.[6] ..... F21V 21/00

[52] U.S. Cl. ..... 362/249; 362/391; 362/396; 248/681; 248/73

[58] Field of Search ..... 362/249, 250, 362/391, 396; 248/65, 68.1, 73, 74.5

[56] References Cited

U.S. PATENT DOCUMENTS

| | | | |
|---|---|---|---|
| 3,982,304 | 9/1976 | Menshen | 248/68.1 |
| 4,840,333 | 6/1989 | Nakayama | 248/73 |
| 4,852,832 | 8/1989 | Delaney | 362/249 X |
| 4,877,209 | 10/1989 | Gary | 248/314 X |
| 4,986,504 | 1/1991 | Gary | 362/249 X |
| 5,110,078 | 5/1992 | Gary | 362/249 X |
| 5,544,031 | 8/1996 | Blanton | 362/396 |

*Primary Examiner*—Stephen F. Husar

*Attorney, Agent, or Firm*—Knobbe, Martens, Olson & Bear, LLP

[57] ABSTRACT

A bracket for mounting wire, especially strings of lights, to interior or exterior structures. The bracket has a body with a counterbored fastener throughbore. The body extends out from the throughbore on either side and includes at least two differently-sized channels for receiving wire. The channels are formed in a face of the body held flush against the structure by the fastener. The throughbore thus extends perpendicular to the channels through the body. A number of brackets clamp portions of the wire close to each light to the structure enabling uniform orientation of the lights therefrom. The bracket is made of clear material to be less conspicuous. The material is preferably acrylic to extend the life of the bracket from exposure when installed on the exterior of a building.

24 Claims, 3 Drawing Sheets

LIGHT STRING MOUNTING BRACKET

FIELD OF THE INVENTION

The present invention relates to a bracket for mounting wire and, more particularly, to an improved bracket for mounting a string of lights.

BACKGROUND OF THE INVENTION

Every year at Christmas, many homeowners perform the ritual decorating of the house with ornaments and lights. This task, while ultimately satisfying, can be a tedious and time-consuming chore. Stringing lights, especially around the outside of the house, can be quite difficult. The homeowner must attach the string of lights at numerous points while attempting to align each one to face in a particular direction. When outside, the light string is sometimes attached along the facer board covering the ends of the roof rafters. This procedure is accomplished from precarious heights either on a ladder or leaning over the roof.

While not as physically demanding as exterior applications, mounting strings of lights around the interior of buildings can also be tedious. Many restaurants and other businesses use strings of lights indoor for non-seasonal decorating, for advertisement purposes or as a promotional gimmick. Alignment of each light in a string of such lights is highly desirable as the customers are likely to notice such attention to detail, which might transfer a positive attribute to the associated service or product, or, conversely, reflect badly on the business if left uneven. The installer finds it quite tedious to align large numbers of individual lights using conventional mounting means. Furthermore, brackets suitable for mounting strings of larger lights on the exterior of a building may be unsuitable for mounting a string of mini-lights in the interior.

Conventional means for attaching the light strings are inconvenient, and suffer many drawbacks. Foremost among problems with common attachment means is the inability to properly orient the individual light bulbs. Most standard clips or brackets simply suspend the light string, allowing individual lights to dangle at random angles, for a less than ideal presentation. This also allows the wire between brackets to dangle, leaving an untidy look.

One conventional attachment device, manufactured by Noma Lites, is a steel clip which is unsightly and highly electrically conductive. PEM Corporation manufactures white nylon brackets for stringing wire, each bracket including a C-shaped wire channel and a side tab through which a nail is run into the facer board. The semipermanence of nails works against easy removal and reinstallation of the brackets and light string. Moreover, the nylon becomes brittle and may break over time, especially if struck with a hammer.

Gray Products Group manufactures two attachment devices which are suitable for miniature light strings only. One provides a plastic receptacle which must be mounted face up on a horizontal surface or the lights will fall out. The receptacle has no positive clamping ability and is mounted with a double sticky adhesive strip, which precludes reinstallation. The second product is a three-inch (7.62 cm) plastic piece designed to wedge between two roof shingles. This mounting arrangement is less than positive and depends on the tension and alignment of the adjacent roof shingles. Moreover, this device will not work with stone roofs, tile roofs, and possibly asphalt shingle roofs. The plastic piece is also very unsightly.

Consequently, there is a need for a device for attaching a string of lights to a structure which is both durable and easy to install. There is also a need for such a device which can uniformly align the individual lights in the string.

SUMMARY OF THE INVENTION

The present invention solves many of the deficiencies of prior light string attachments by allowing each individual light to be oriented easily with respect to the others. One aspect of the invention provides a lighting system wherein a plurality of brackets fasten a light string to a structure, each bracket being positioned close to a light and clamping the wire of the string to firmly hold the light in a particular orientation. The brackets are provided with at least two channels of different sizes to accommodate different wire sizes. The channels provide a small clamping force to the wires. The clamping force not only allows for orienting the lights, but also enables the wire to be held taut between the lights.

In accordance with one particular embodiment, a bracket for mounting a string of lights includes a body portion having a throughbore from a lower face to an upper face. A pair of parallel channels opens to the upper face of the body. The channels are aligned substantially perpendicular to the throughbore axis on either side of the throughbore and are sized differently to accommodate different sized wires. Preferably the body includes a counterbore concentric with the throughbore and opening to the lower face for recessing a head of a fastener extending through the throughbore.

In another aspect, the present invention provides a system for mounting a wire to a structure. The system includes a bracket defined by a body having a throughbore from a lower face to an upper face, a counterbore concentric with the throughbore and opening to the lower face, and a pair of parallel channels open to the upper face of the body. The channels are aligned substantially perpendicular to the throughbore axis on either side of the throughbore, and are sized differently to accommodate different sized wires. The system includes a screw fastener sized to fit within the throughbore with the head of the fastener sized to fit within the counterbore. The wire is clamped to a structure within one of the channels by extending the fastener into the structure via the throughbore so that the flat head abuts the counterbore.

In another form, the present invention encompasses a lighting system comprising a string of lights including a plurality of individual lights electrically connected by a wire. The lighting system provides a flat surface for mounting the string and a plurality of brackets. Each bracket includes a body portion having a throughbore from a lower face to an upper face, and a pair of parallel channels open to the upper face of the body, the channels aligned substantially perpendicular to the throughbore axis on either side of the throughbore. The channels are sized differently, at least one of the channels being sized slightly smaller than the wire. A plurality of fasteners are sized to fit within the throughbore, wherein the wire is clamped to the flat surface within one of the channels by extending the fastener into the flat surface via the throughbore. Desirably, the brackets are made of clear molded plastic.

In a preferred method for mounting a string of lights to a structure, the string of lights including a wire having a plug and a plurality of lights electrically connected along the wire, a first bracket is loosely attaching to the structure. The bracket has a rectangular parallelepiped body with a throughbore extending through a narrow dimension from an upper face to a lower face. A portion of the string of lights is threaded between the upper surface of the first bracket and the structure until the portion is received within a channel formed in the upper surface, the portion being located proximate a first light in the string. The first light is rotated generally about the line along the wire in a desired orientation with respect to the structure. The bracket is tightly attached to the structure to clamp the portion in the channel, securing the first light in the desired orientation.

In accordance with another aspect, a method for mounting a light string to a structure is provided by the present invention. A bracket is loosely attached to the structure, the bracket having a rectangular parallelepiped body with a throughbore extending through a narrow dimension from an upper face to a lower face and a pair of differently sized parallel channels open to the upper face of the body. The channels are aligned substantially perpendicular to the throughbore axis and located on either side of the throughbore. A light string is selected including a wire and a plurality of lights, so that the wire is sized slightly larger than a first one of the channels. A portion of the wire is threaded between the upper face of the bracket and the structure until the portion is received within a channel formed in the upper face, the portion being located proximate a light in the string. The light is rotated generally about the line along the wire in a desired orientation with respect to the structure. Finally, the bracket is tightly attached to the structure to clamp the portion in the channel, securing the light in the desired orientation. In one option, the light string is selected having a wire sized larger than both of the channels. In another option, the light string is selected having a wire sized larger than only one of the channels.

DESCRIPTION OF THE PREFERRED EMBODIMENT

Figure 1A:
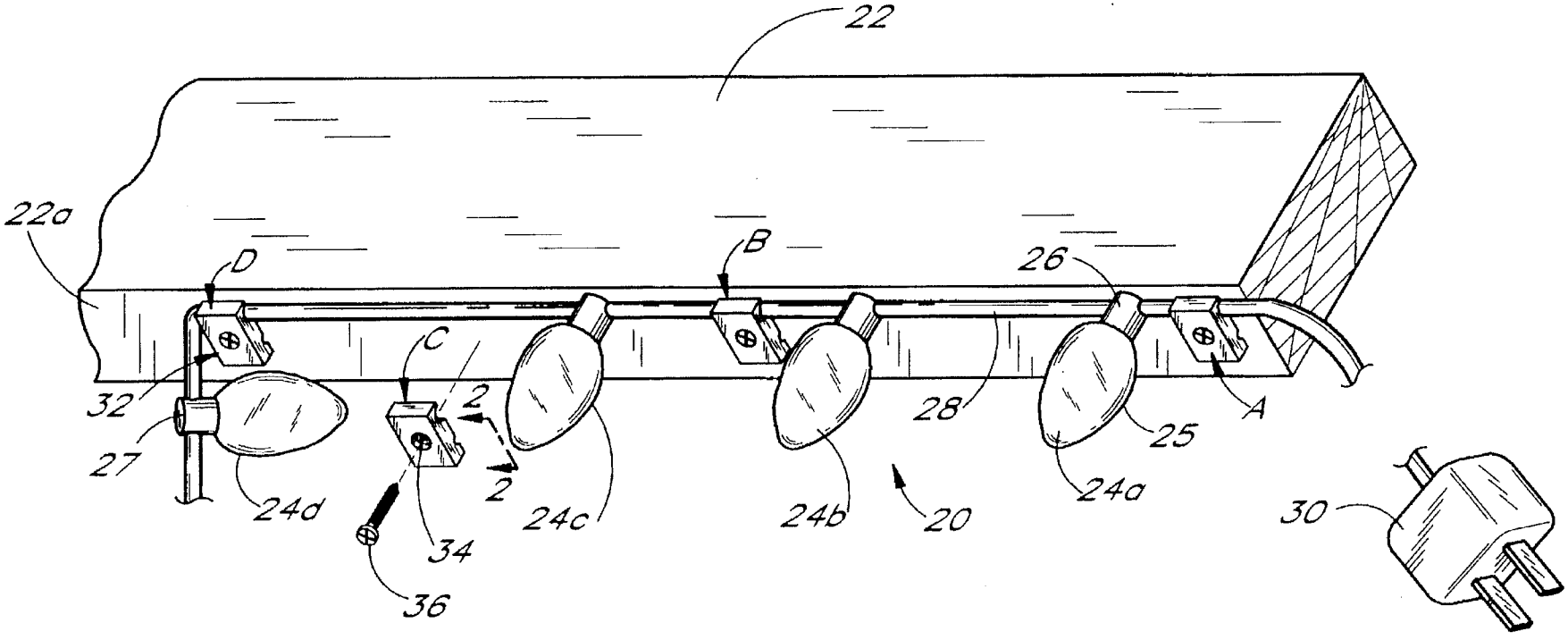
FIG. 1*a* is a perspective view of a string of large lights mounted to a facer board with brackets according to one embodiment of the present invention.

FIG. 1*a* illustrates a string of large lights 20 suspended from a lower edge 22*a* of a facer board 22 covering the roof rafters of a house. Such a facer boards 22 typically comprise planks of between 1"×4" to 2"×12" extending along and just below the edges of the house roof. Of course, the present invention may be suitable for attaching a string of lights to any number of structures, both inside and out, the facer board 22 being used as a convenient and typical mounting environment.

Figure 1B:
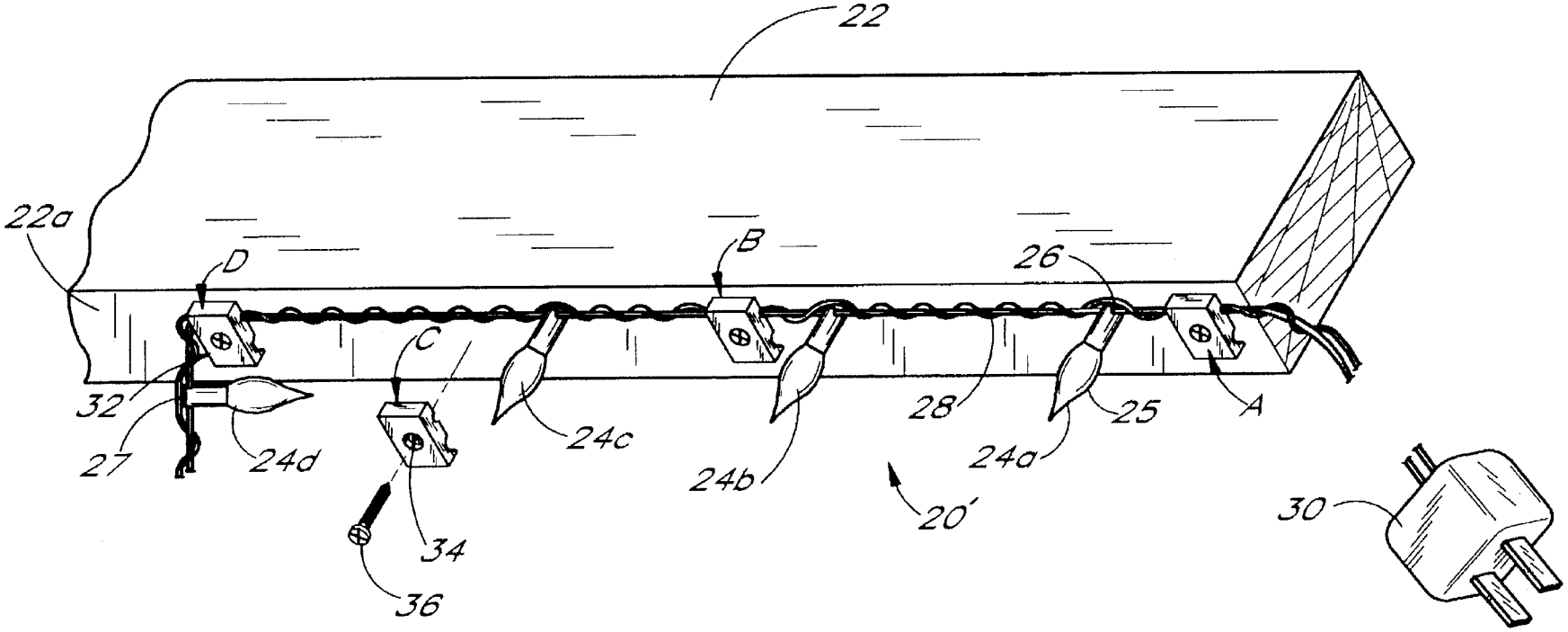
FIG. 1*b* is a perspective view of a string of mini-lights mounted to a facer board with brackets according to one embodiment of the present invention.

The string of lights 20 comprises a number of individual lights 24*a*, 24*b*, 24*c*, and 24*d* having bulbs 25 and bases 26 and being electrically connected along a wire 28. The string 20 normally terminates at a first end in a conventional AC plug 30. Such strings 20 are commercially available from a number of manufacturers in different lengths and with different light sizes. Furthermore, the wire 28 may be of varying size depending on the wattage capacity of the string of lights. In particular, FIG. 1*b* shows a string of mini-lights 20' mounted to a facer board 22.

FIG. 1*a* illustrates a plurality of brackets 32 utilized for attaching the string of lights 20 to the facer board 22. The brackets 32 are positioned at intervals along a string of lights 20. Desirably, the brackets 32 secure the light string 20 to the facer board 22 at locations proximate the individual lights 24. More particularly, the brackets 32 are preferably positioned within approximately two inches (5.08 cm) of each light 24. The majority of the brackets 32 are preferably positioned on the side away from the plug 30, except for the initial bracket in the light string 20 for reasons which will be explained below. If the light string 20 is routed around a corner, the last bracket 32 prior to the bend will be positioned on the side toward the plug 30, as seen in FIGS. 1*a* and 1*b*. The light string 20 is preferably strung taut between the brackets 32 so that the wire 28 lies flush against the lower edge 22*a* of the facer board 22.

The brackets 32 include a generally centrally located throughbore 34 which receives a fastener 36 extending into the facer board 22. The fastener 36 may be various types of screws, and is preferably a pan head Phillips sheet metal screw. Other types of screws, such as wood screws, are not recommended because screws having tapered heads are less than desirable as the taper creates unwanted stresses in the bracket 32 when the fastener 36 is excessively tightened.

Figure 2:
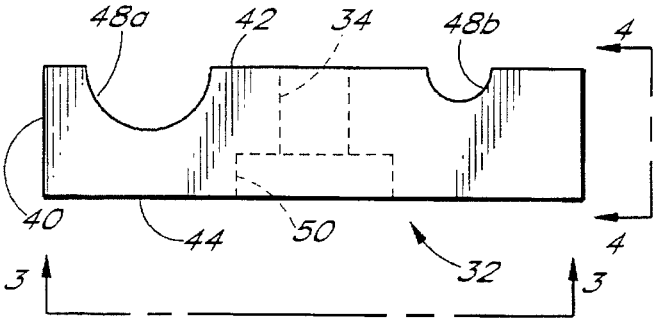
FIG. 2 is a side elevational view of a bracket according to the present invention taken along line 2—2 in FIG. 1*a;*
Figure 4:
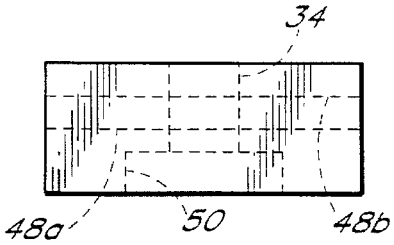
FIG. 4 is an end elevational view of the bracket of the present invention taken along line 4—4 of FIG. 2.
Figure 3:
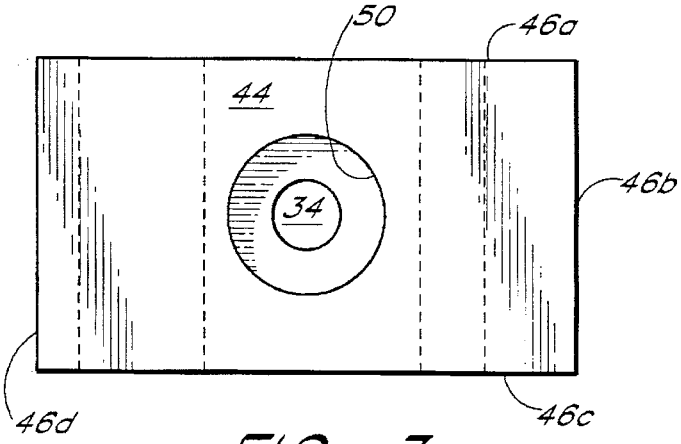
FIG. 3 is a bottom plan view of the bracket of the present invention taken along line 3—3 of FIG. 2.

With reference to FIGS. 2–4, the bracket 32 comprises a generally rectangular parallelepiped body 40 having an upper major surface 42 and a lower major surface 44. The throughbore 34 extends perpendicularly from the upper surface 42 to the lower surface 44. The upper and lower surfaces 42, 44 are disposed parallel to one another and are defined by a rectangle formed by four outer sides 46*a*–*d*, as seen in FIG. 3. In the present embodiment, the first and third sides 46*a* and 46*c* are longer than the second and fourth sides 46*b* and 46*d*.

The upper major surface 42 is interrupted by a pair of parallel wire-receiving channels 48*a* and 48*b*. A deeper channel 48*a* extends from the first side edge 46*a* to the third side edge 46*c*. A shallower channel 48*b* also extends from the first side edge 46*a* to the third side edge 46*c*. The channels 48*a*,*b* are preferably semicylindrical in shape, with a central axis located in the plane of the upper major surface 42. The radius of the deeper channel 48*a* is preferably slightly greater than one-half of the thickness of the body 40 from the upper major surface 42 to the lower major surface 44. The shallower channel 48*b* has a radius which is approximately one-quarter of the thickness of the body 40. In one specific embodiment, the body 40 has a thickness of 3/16 inch (0.476 cm), while the deep channel 48*a* has a radius of 7/64 inch (0.278 cm), and the shallow channel 48*b* has a radius of 7/128 inch (0.139 cm). The channels 48*a*,*b* are designed to accommodate wires 28 of varying diameters, and thus may be modified for the particular need.

Conventional light string wires 28 come in two basic forms. For smaller "mini-lights," as seen in FIG. 1*b*, the wire 28 is defined by two individual wires twisted together without any common sheath thereover. Each separate wire has an insulation coating and a diameter of approximately 1/16 inch (0.159 cm). Two such twisted wires present a maximum cross-sectional dimension of 1/8 inch (0.318 cm), while the diameter of the shallow channel is 7/64 inch (0.278 cm), thus providing for a small compressive force being applied to the twisted wires upon installation of a bracket 32 thereover. Mini-light strings typically comprise 25 lights electrically connected in series, each light having an operating voltage of approximately 5 V and the string running on standard 120 V house current. Larger light strings, on the other hand, are electrically connected in parallel and run on standard 120 V house current. For strings of larger lights 24, as seen in FIG. 1*a*, the wire 28 comprises two parallel wires encased in tubes of non-conductive insulating material, the tubes being joined at a central web. Each tube has an approximate diameter of 0.100 inch (0.254 cm), resulting in a maximum cross-sectional dimension of about 0.200 inch (0.508 cm). Although the deeper channel 48*a* has a larger diameter of 7/32 inch (0.556 cm), the curvature of the channel walls contacts and clamps the wire 28 to the facer board 22. By frictionally clamping the wire 28 to the facer board 22, the rotational position of each light 24 in the string, which is clamped proximate the bracket 32, can be controlled. Furthermore, the wire 28 between brackets 32 may be clamped taut, to provide a desirable straightened appearance. The channels 48*a,b* are so sized to clamp the wire 28 without excessive compression, to avoid damaging the wire. The channels illustrated are particularly suited for the aforementioned wire sizes, and are for example only, other wire sizes may be accommodated by differently sized channels.

The brackets 32 include a counterbore 50 extending from the lower major surface 44 toward the upper major surface 42. The throughbore 34 is concentrically aligned with the counterbore 50. As seen in FIG. 2, the counterbore 50 extends approximately one-third of the thickness of the body 40. In one specific embodiment, the counterbore has a depth of approximately 1/16 inch (0.159 cm), with the body 40 having a thickness of 3/16 inch (0.476 cm). The counterbore 50 provides a recess for the head of the fastener 36. As mentioned previously, provision of a counterbore 50 and a fastener 36 having a flat-bottomed head, prevents the application of oblique stresses within the brackets 32 from tightening of tapered head wood fasteners, for example.

The present invention also comprises a preferred method of installation of a string of lights 20 or 20'. With reference to FIGS. 1*a* or 1*b*, the light strings 20 and 20' are attached to the facer board 22 beginning at the first end closest to the plug 30. A first bracket 32, indicated at A, mounts to the facer board 22 proximate the first light 24*a* on the plug side of the string 20. A second bracket B is then mounted proximate the second light 24*b* away from the plug side of the string 20, and a third bracket C is attached proximate the third light 24*c*, and so on, all other brackets except one in the straight line being positioned away from the plug side of their respective lights. A fourth bracket D is shown at the end of the line of lights prior to routing the string 20 in a different direction, in this case downward. The fourth bracket D is attached proximate a fourth light 24*d* to the plug side of the string 20 to assist in forming a tight bend.

The brackets 32 are aligned on the bottom edge 22*a* of the facet board 22 with either of the shorter sides 46*b* or 46*d* substantially flush with the front face of the board, and with the counterbore 50 facing downward. A hole is then drilled to approximately ½ inch (1.27 cm) deep in the board via the throughbore 34. The hole is drilled perpendicular to the bottom edge 22*a* of the facer board with a drill bit sized slightly smaller than the major diameter of the threads on the fastener 36. In one particular embodiment, a 3/32 inch (0.238 cm) drill bit is used with pan head sheet metal screws having a major diameter no greater than ⅛ inch (0.318 cm), which is the preferred inner diameter of the throughbore 34.

While manually holding the bracket 32 in place, the fastener 32 is installed into the throughbore 34 and into the drilled hole in the facer board 22 a short distance. A space is left between the upper surface 42 and the lower edge 22*a* of the facer board for passing the wire 28 of the light string 20. When the wire 28 is positioned within the channel 48*a* or 48*b* closest to the front face of the facer board 22, the fastener 36 is fully installed clamping the wire 28 to the bottom edge 22*a*. During the final clamping of the bracket 32 onto the wire 28, the installer preferably positions the light 24 perpendicular to the lower edge 22*a* to ensure a uniform appearance. Specifically, each light 24 is rotated about an axis generally disposed through the base 26 and along the wire 28 until the correct orientation is attained.

The placement of the brackets 32 on either side of each respective light 24 facilitates installation and alignment of each light. More specifically, the first bracket A establishes an anchor when starting a line of lights. Each subsequent intermediate bracket allows the respective light to be properly aligned while being supported thereby. For example, the second bracket B is loosely attached to the left of the second light 24*b*, and the wire on the left of the bracket manipulated to orient the light to the proper position, whereupon the bracket B is tightened.

In some light strings 20, the base 26 of each light 24 is flat on the upper surface 27 to facilitate the perpendicular orientation with respect to the lower edge 22*a*. It is important to tighten the fastener 36 only far enough to clamp the wire 28, without overtightening to avoid undue stresses within the wire or bracket 32. The length of the channels 48*a,b* helps prevent "pinching" of the wires at points of focussed stress. Thus, the length of the channels 48*a* or 48*b* is preferably at least 4 times their radius to spread out the compression on the wire 28.

To remove the light string 20, each bracket 32 is loosened by reversing the corresponding fastener 36 to allow the wire 28 to fit between the upper surface 42 and the facer board 22. The brackets 32 are left in place and the fasteners 36 are preferably nominally tightened again to hold the brackets to the facer board. In this manner, the brackets 32 need only be installed once, the installer simply loosening them again to re-install the string of lights 20.

The bracket 32 is preferably injection molded out of a clear plastic such as acrylic-GP. In one particular embodiment, the bracket 32 has a length of approximately ¾ inch (1.905 cm), and a width of approximately 7/16 inch (1.113 cm). Other materials which are nonconductive to electricity and which are durable over extended periods of exposure to the elements may be used. For example, a composite material may be utilized. Furthermore, more than two sizes of channels 48 may be provided in each bracket 32. The present invention contemplates mounting two general sizes of wires 28, but other sizes may be accommodated by providing different size channels. Of course, with the provision of only one fastener 36, the bracket 32 is preferably kept relatively short to ensure a strong clamp to the facer board 22, and to keep the bracket length shorter than the facer board width so as not to extend beyond the facer board for a tidier appearance.

The bracket 32 is made clear to reduce its visibility when mounted on the facer board 22. Indeed, from a distance the brackets are inconspicuous if not invisible and enhance the ornamental effect of the string of lights 20 or 20' Furthermore, when the string of lights 20 is removed, the innocuous brackets can be left in place for the next desired use.

Although this invention has been described in terms of certain preferred embodiments, other embodiments that are apparent to those of ordinary skill in the art are also within the scope of this invention. Accordingly, the scope of the invention is intended to be defined by the claims that follow.

I claim:

1. A bracket for mounting a string of lights, comprising:

a body portion having a throughbore from a lower face to an upper face; and a pair of parallel channels opens to said upper face of the body, said channels aligned substantially perpendicular to the throughbore axis and located on either side of the throughbore, said channels being sized differently to accommodate different sized wires.

2. The bracket of claim 1, further comprising:

a counterbore concentric with said throughbore and opening to said lower face for recessing a head of a fastener extending through said throughbore.

3. The bracket of claim 1, wherein said channels comprise first and second channels generally formed in semicylinders, the radius of said first channel being slightly greater than one-half the thickness of the body from the upper surface to the lower surface.

4. The bracket of claim 1, wherein said channels comprise first and second channels generally formed in semicylinders, the radius of said second channel being slightly greater than one-quarter the thickness of the body from the upper surface to the lower surface.

5. The bracket of claim 1, wherein said body is formed as a rectangular parallelepiped and said upper and lower surfaces comprise flat major sides of said body, said throughbore extending through the small dimension of said body.

6. The bracket of claim 1, wherein said body is formed of clear non-electrically conductive material.

7. The bracket of claim 6, wherein said body is acrylic.

8. A system for mounting a wire to a structure, comprising:

a bracket defined by a body having a throughbore from a lower face to an upper face, a counterbore concentric with said throughbore and opening to said lower face, and a pair of parallel channels open to said upper face of the body, said channels aligned substantially perpendicular to the throughbore axis and located on either side of the throughbore, said channels being sized differently to accommodate different sized wires; and a screw fastener sized to fit within said throughbore with the head of said fastener sized to fit within said counterbore, wherein said wire is clamped to a structure within one of said channels by extending said fastener into said structure via said throughbore so that said flat head abuts said counterbore.

9. The system of claim 8, wherein said channels comprise first and second channels generally formed in semicylinders, the radius of said second channel being slightly greater than one-quarter the thickness of the body from the upper face to the lower face and radius of said first channel being slightly greater than one-half the thickness of the body from the upper face to the lower face.

10. The system of claim 8, wherein said body is formed of clear non-electrically conductive material.

11. The system of claim 10, wherein said body is acrylic.

12. The system of claim 8, wherein said screw fastener has a flat-bottomed head to contact flush with said counterbore.

13. A lighting system, comprising:

a string of lights including a plurality of individual lights electrically connected by a wire;

a flat surface for mounting said string;

a plurality of brackets, each bracket including a body portion having a throughbore from a lower face to an upper face, each bracket having a pair of parallel channels open to said upper face of the body, said channels aligned substantially perpendicular to the throughbore axis and located on either side of the throughbore, said channels being sized differently, at least one of said channels being sized slightly smaller than said wire; and a plurality of fasteners sized to fit within said throughbore, wherein said wire is clamped to said flat surface within one of said channels by extending said fastener into said flat surface via said throughbore.

14. The lighting system of claim 13, wherein said brackets are made of clear molded plastic.

15. The lighting system of claim 13, wherein said flat surface is located on the exterior of a building.

16. The lighting system of claim 13, wherein said flat surface is located in the interior of a building.

17. A method for mounting a string of lights to a structure, said string of lights including a wire having a plug and a plurality of lights electrically connected along said wire, comprising the steps of:

loosely attaching a first bracket to the structure, said bracket having a body with a throughbore extending through a narrow dimension from an upper face to a lower face;

threading a portion of the string of lights between the upper surface of the first bracket and the structure until said portion is received within a channel formed in said upper surface, said portion being located proximate a first light in said string;

rotating said first light generally about the line along said wire in a desired orientation with respect to said structure; and tightly attaching said bracket to said structure to clamp said portion in said channel, securing said first light in said desired orientation.

18. The method of claim 17, wherein said portion is located between said first light and the plug of said string.

19. The method of claim 18, further comprising the step of:

tightly attaching a second bracket to said structure to clamp a second portion of said wire to said structure, securing a second light in said desired orientation, wherein said second light is located between said second portion and the plug of said string.

20. The method of claim 17, wherein the step of loosely attaching said first bracket to the structure includes inserting a threaded fastener into said throughbore and screwing said fastener into said structure.

21. The method of claim 20, wherein the step of tightly attaching said first bracket to the structure includes screwing said fastener into said structure.

22. A method for mounting a light string to a structure, comprising the steps of:

loosely attaching a bracket to the structure, said bracket having a rectangular parallelepiped body with a throughbore extending through a narrow dimension from an upper face to a lower face and a pair of differently sized parallel channels open to said upper face of the body, said channels aligned substantially perpendicular to the throughbore axis and located on either side of the throughbore;

selecting a light string including a wire and a plurality of lights, so that said wire is sized slightly larger than a first one of said channels;

threading a portion of the wire between the upper face of the bracket and the structure until said portion is received within a channel formed in said upper face, said portion being located proximate a light in said string;

rotating said light generally about the line along said wire in a desired orientation with respect to said structure; and tightly attaching said bracket to said structure to clamp said portion in said channel, securing said light in said desired orientation.

23. The method of claim 22, wherein said step of selecting a light string further comprises selecting said string having a wire sized larger than both of said channels.

24. The method of claim 22, wherein said step of selecting a light string further comprises selecting said string having a wire sized larger than only one of said channels.

* * * * *